US005274304A

United States Patent [19]

Nishida

[11] Patent Number: 5,274,304

[45] Date of Patent: Dec. 28, 1993

[54] HELIX TYPE TRAVELING WAVE TUBE STRUCTURE WITH SUPPORTING RODS COVERED WITH BORON NITRIDE OR ARTIFICIAL DIAMOND

[75] Inventor: Kazuhisa Nishida, Tokyo, Japan

[73] Assignee: NEC Corporation, Tokyo, Japan

[21] Appl. No.: 861,547

[22] Filed: Apr. 1, 1992

[30] Foreign Application Priority Data

Apr. 1, 1991 [JP] Japan ..... 3-68195

[51] Int. Cl.[5] ..... H01J 23/24

[52] U.S. Cl. ..... 315/3.5; 315/39.3

[58] Field of Search ..... 315/3.5, 39.3; 333/162

[56] References Cited

U.S. PATENT DOCUMENTS 2,806,171 9/1957 Iversen ..... 333/162 X
2,903,657 9/1959 Eichen ..... 315/39.3 X
3,466,494 9/1969 Eichen et al. ..... 315/39.3 X
4,005,329 1/1977 Manoly ..... 315/39.3 X
4,278,914 7/1981 Horper ..... 315/39.3 X

*Primary Examiner*—Benny T. Lee
*Attorney, Agent, or Firm*—Sughrue, Mion, Zinn, Macpeak & Seas

[57] ABSTRACT

A traveling wave tube structure is used for propagation of an electron beam, and includes a metal tube member having an inner surface defining a hollow space, a helix member provided in the hollow space, and a plurality of supporting rods provided between the inner surface and the helix member and circumferentially spaced at predetermined angles from one another. Each of the supporting rods is formed from a quartz rod member covered with a substance selected from the group consisting of boron nitride and artificial diamond. The quartz contributes mechanical strength while the named covering substances are especially beneficial due to their dielectric constants and thermal conductivities.

5 Claims, 3 Drawing Sheets

HELIX TYPE TRAVELING WAVE TUBE STRUCTURE WITH SUPPORTING RODS COVERED WITH BORON NITRIDE OR ARTIFICIAL DIAMOND

FIELD OF THE INVENTION

This invention relates to a helix type traveling wave tube structure and, more particularly, to supporting rods associated with the helix of the traveling wave tube structure.

DESCRIPTION OF THE RELATED ART

The helix type traveling wave tube structure, such as a traveling wave tube or a backward traveling wave tube, serves as a delay circuit structure. Since an electron beam passes close thereto, part of the electron beam impinges upon the helix type traveling wave tube structure and produces heat. The resistance loss of the high-frequency electric power also produces heat. If the helix type traveling wave tube structure has a low heat capacity, the helix type traveling wave tube structure reaches a fairly high temperature. This fairly high temperature increases the high-frequency resistance loss, and promotes generation of gas. This, in turn, results in deterioration of the output power characteristics as well as of the beam transmission, and undesirable noises are increased. Moreover, these undesirable phenomena reduce the service life of the helix type traveling wave tube structure.

On the other hand, future applications will require helix type traveling wave tube structures to propagate electron beams of higher-frequency and larger-power. Accordingly, research and development efforts have been made on heat-resistive helices, supporting rods utilizing substances having a large dielectric constant, and cooling technologies.

FIGS. 1 and 2 show a typical example of a traveling wave tube structure. This prior art traveling wave tube structure comprises a metal tube member 1, and a helix member 2 inserted in the metal tube member 1. The helix member 2 extends along the longitudinal direction of the metal tube member 1, and is formed of refractory metal such as tungsten or molybdenum, because the refractory metal is less deformable when an electron beam impinges thereon. The helix member may be formed by a refractory metal tape. The prior art traveling wave tube structure further comprises three supporting rods 3*a*, 3*b* and 3*c* (see FIG. 2) inserted between the metal tube member 1 and the helix member 2. The supporting rods 3*a*, 3*b* and 3*c* and the helix member 2 are stationary with respect to the metal tube member 1. The supporting rods 3*a*, 3*b* and 3*c* are formed of a dielectric substance. Beryllia ceramic has been used as the dielectric substance, because beryllia ceramic is large in heat conductivity. However, aluminum nitride or anisotropic boron nitride having small dielectric constants have been developed and are also available as the dielectric substance. The anisotropic boron nitride has a laminated structure. If the direction parallel to the component layers and the direction perpendicular to the component layers are respectively referred to as "a-direction" and "c-direction", the physical and mechanical properties of such a substance differ widely between the a-direction and the c-direction. Particularly, the physical and mechanical properties in the a-direction are better than those in the c-direction. For this reason, the supporting rods 3*a*, 3*b* and 3*c* are arranged in such a manner that the a-direction is substantially perpendicular to surfaces 4 contacting the helix member 2. Accordingly, the c-direction is substantially parallel to the contact surfaces 4. Magnetic units (not shown) are provided around the metal tube member 1 so as to confine the electron beam within the helix member 2. The metal tube member 1 is usually formed of stainless steel.

As described hereinbefore, the helix member 2 and the supporting rods 3*a* to 3*c* are stationary with respect to the metal tube member 1. This is achieved through a distortion squeezing technique applied thereto. Namely, a radial force is outwardly exerted on the metal tube member 1, and, accordingly, the metal tube member 1 is increased in diameter. The helix member 2 accompanied with the supporting rods 3*a* to 3*c* are inserted into the radially expanded metal tube member 1. Thereafter, the radial force is removed from the metal tube member 1. Then, the metal tube member 1 squeezes the supporting rods 3*a* to 3*c* and the helix member 2, and the elastic force of the metal tube member 1 renders the helix member 2 and the supporting rods 3*a* to 3*c* stationary with respect to the metal tube member 1.

If the supporting rods 3*a* to 3*c* are formed of beryllia ceramic or aluminum nitride, the thermal conductivity and the mechanical strength are acceptable. However, the dielectric constant is relatively high, i.e., epsilon=6.5 to 8, and the relatively high dielectric constant is undesirable in view of efficiency of the traveling wave tube structure. Since anisotropic boron nitride exhibits low mechanical strength, the contact surfaces 4 of the supporting rods 3*a* to 3*c* are quite susceptible to cracking due to the shearing force exerted thereon upon squeezing if the supporting rods 3*a* to 3*c* are formed of anisotropic boron nitride. The cracks deteriorate the high frequency characteristics of the structure, and the gain is lowered. The cracks tend to develop and grow due to repeated exposure to heat, and, finally, the traveling wave tube becomes inoperable.

Thus, there is a trade-off between the dielectric constant and the mechanical strength.

SUMMARY OF THE INVENTION

It is therefore an important object of the present invention to provide a helix type traveling wave tube structure, the supporting rods of which are formed of a substance having dielectric constant and mechanical strength characteristics that constitute marked improvement over the prior art.

To accomplish the object, the present invention proposes to form a supporting rod by using a quartz rod covered with boron nitride or with artificial diamond.

In accordance with the present invention, there is provided a traveling wave tube structure, comprising: a) a metal tube member having an inner surface defining a hollow space; b) a helix member provided in the hollow space; and c) a plurality of supporting rods provided between the inner surface and the helix member, and circumferentially spaced at predetermined angle from one another, each of the supporting rods being implemented by a quartz rod member covered with substance selected from the group consisting of boron nitride and artificial diamond.

The flexural strength of quartz can be as great as 7 $kg/mm^2$, and the dielectric constant of quartz is of the order of 3.9. However, the thermal conductivity of quartz is about 1 watt/m·k, and is too small to use as the substance of a supporting rod when compared with that of beryllium oxide (250 watt/m·k). On the other hand, boron nitride and artificial diamond have thermal conductivities in the range of 60 watt/m·k, and their dielectric constants range between 3 to 6. Therefore, a composite material of quartz and at least one of the latter materials; is preferable for a supporting rod as compared to the substances utilized by the prior art.

BRIEF DESCRIPTION OF THE DRAWINGS

The features and advantages of the helix type traveling wave tube structure according to the present invention will be more clearly understood from the following description taken in conjunction with the accompanying drawings in which.

DESCRIPTION OF THE PREFERRED EMBODIMENTS

First Embodiment

Figure 1:
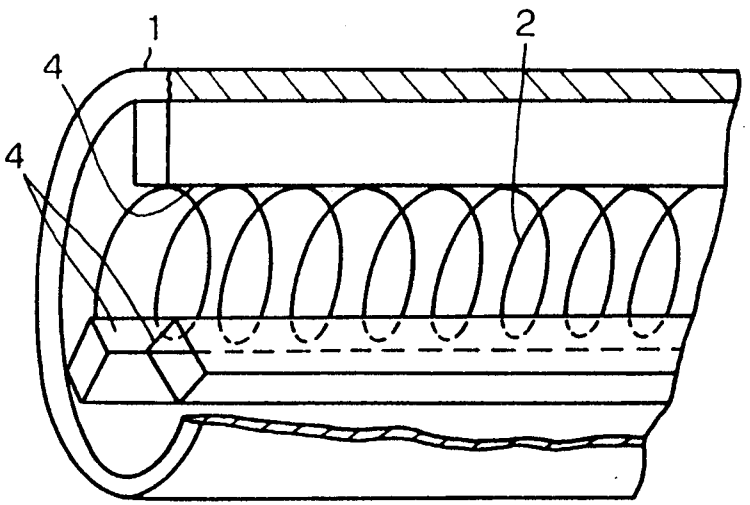
Fig. 1 PRIOR ART
FIG. 1 is a partially cut-away perspective view showing the structure of the prior art traveling wave tube structure.
Figure 2:
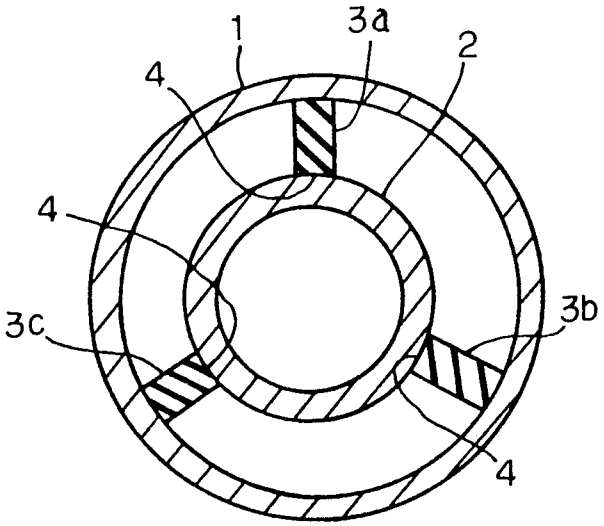
Fig. 2 PRIOR ART
FIG. 2 is a cross sectional view showing the arrangement of the prior art traveling wave tube structure.
Figure 3:
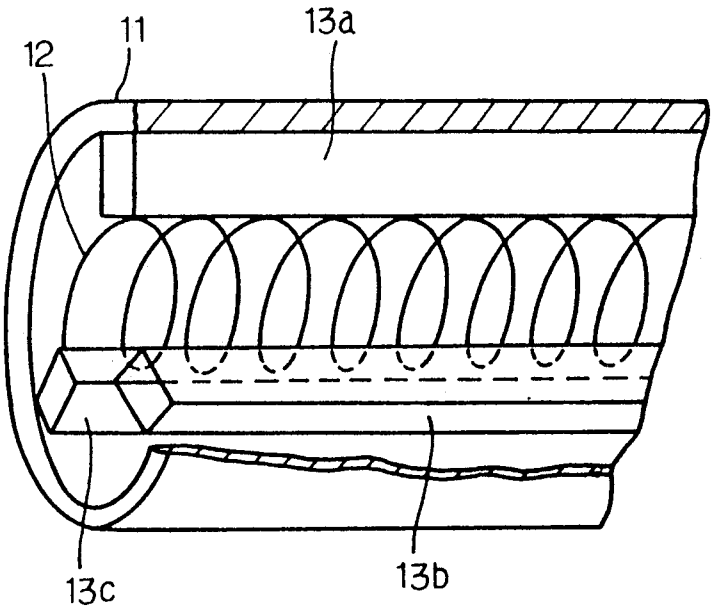
FIG. 3 is a partially cut-away perspective view showing the structure or a traveling wave tube structure according to the present invention.
Figure 4:
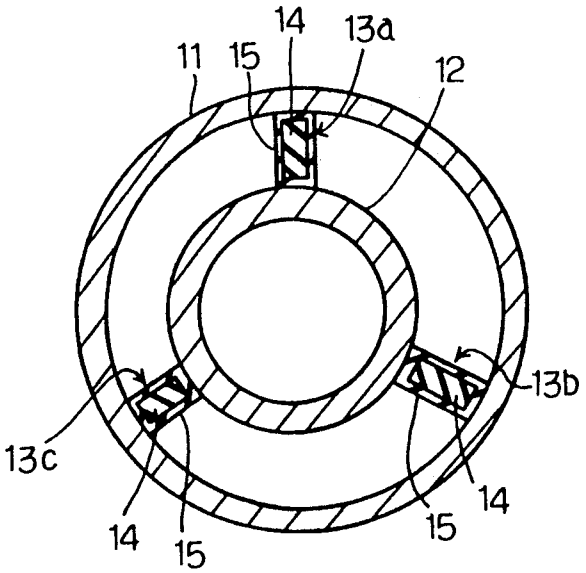
FIG. 4 is a cross sectional view showing the arrangement of the traveling wave tube structure shown in FIG. 3.

Referring to FIGS. 3 and 4 of the drawings, a traveling wave tube structure embodying the present invention comprises a metal tube member 11 of stainless steel, a helix member 12 of tungsten inserted in the inner hollow space of the metal tube member 11, and supporting rods 13*a*, 13*b* and 13*c*. The helix member 12 extends along the longitudinal direction of the metal tube member 11, and is formed from a tungsten tape having a width of about 1.5 millimeters and a thickness of about 1 millimeter. The helix member 12 has an inside diameter of about 2 millimeters.

Each of the supporting rods 13*a* to 13*c* has a rectangular cross section of 1 millimeter by 2 millimeters, and is about 100 millimeters in length. As shown in FIG. 4, the supporting rods 13*a* to 13*c* are spaced apart from one another at about 120 degrees. Each of the supporting rods 13*a* to 13*c* is formed of a quartz rod 14 covered with a boron nitride film 15. The boron nitride film 15 is deposited to a thickness of about 50 microns by using a plasma-assisted chemical vapor deposition process.

The helix member 12 and the supporting rods 13*a* to 13*c* are fixed to the metal tube member 11 through the distortion squeezing technique. Namely, a radial force is outwardly exerted on the metal tube member 11, and, accordingly, the metal tube member 11 increases in diameter. The helix member 12, together with the supporting rods 13*a* to 13*c* is inserted into the hollow space of the radially expanded metal tube member 11, and the radial force is removed from the metal tube member 11. Then, the metal tube member 11 squeezes the supporting rods 13*a* to 13*c* and the helix member 12. The elastic force of the metal tube member 11 renders the helix member 12 and the supporting rods 13*a* to 13*c* stationary with respect to the metal tube member 11.

Since the quartz exhibits a sufficiently high mechanical strength to withstand the elastic force, no cracks develop in the surfaces of the supporting rods 13*a* to 13*c* contacting the helix member 12, and high reliability is achieved. Moreover, the boron nitride films 15 are low in dielectric constant and high in thermal conductivity. Thus the traveling wave tube structure according to the first embodiment achieves high efficiency and large high-frequency output characteristics.

Second Embodiment

Figure 5:
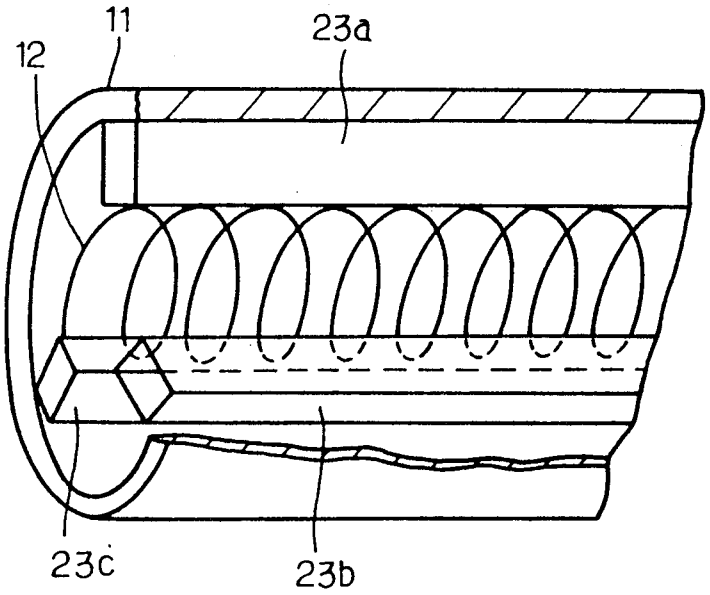
FIG. 5 is a partially cut-away perspective view showing the structure of another traveling wave tube structure according to the present invention.
Figure 6:
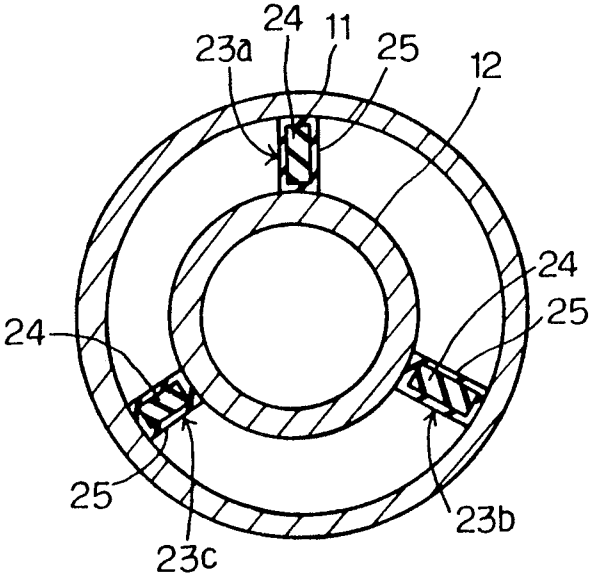
FIG. 6 is a cross sectional view showing the arrangement of the traveling wave structure shown in FIG. 5.

Turning to FIGS. 5 and 6 of the drawings, another traveling wave tube structure embodying the present invention is illustrated. The traveling wave tube structure shown in FIGS. 5 and 6 is similar in structure to the first embodiment except for supporting rods 23*a*, 23*b* and 23*c*. As such, the other components are labeled with the same reference numerals designating corresponding components of the first embodiment, and detailed description of the corresponding components is omitted for the sake of simplicity. Each of the supporting rods 23*a*, 23*b* and 23*c* is about 100 millimeters in length, and has a generally rectangular cross section of 1 millimeter by 2 millimeters. As shown in FIG. 6, the supporting rods 23*a* to 23*c* are implemented by respective quartz rods 24 covered with artificial diamond films 25, respectively. The thickness of each artificial diamond film 25 ranges from about 5 microns to about 100 microns. The artificial diamond is deposited by using a plasma-assisted chemical vapor deposition technique. The helix member 12 and the supporting rods 23*a* to 23*c* are fixed to the metal tube member 11 through the distortion squeezing technique.

Since artificial diamond is large enough in mechanical strength to withstand the resulting elastic force, no cracking takes place in the surfaces of the supporting rods 23*a* to 23*c* contacting the helix member 12. Thus high reliability is achieved. Moreover, the artificial diamond films 25 are low in dielectric constant and high in thermal conductivity, and, accordingly, the traveling wave tube structure according to the second embodiment also achieves high efficiency and large high-frequency output characteristics.

Although particular embodiments of the present invention have been shown and described, it will be obvious to those skilled in the art that various changes and modifications may be made without departing from the spirit and scope of the present invention. For example, the helix member may be formed of another refractory, and a refractory metal wire may be available for the helix member. Various deposition techniques are available for the boron nitride films and the artificial diamond films. Moreover, the metal tube member is not limited to stainless steel.

What is claimed is:

1. An electron beam propagation tube structure for a traveling wave tube, comprising:

a) a metal tube member having an inner surface and defining a hollow space therein;

b) a conductive helix member provided in the hollow space; and c) a plurality of supporting rods which are provided between the inner surface and said helix member, and spaced which are at predetermined angles from one another, each of said supporting rods being comprised of a quartz rod member having an outer surface thereof covered with a substance, wherein said substance is selected from the group consisting of boron nitride and artificial diamond.

2. A tube structure as set forth in claim 1, in which said substance has a thickness ranging from 5 microns to 100 microns.

3. A tube structure as set forth in claim 1, wherein said substance completely covers the outer surface of said quartz rod.

4. A tube structure as set forth in claim 1, in which said helix member is comprised of a tungsten tape.

5. A tube structure as set forth in claim 1, in which said metal tube member is comprised of stainless steel.

* * * * *